US005221932A

United States Patent [19]

Kurita

[11] Patent Number: 5,221,932

[45] Date of Patent: Jun. 22, 1993

[54] THERMAL HEAD APPARATUS AND METHOD OF ASSEMBLING THERMAL HEAD APPARATUS

[75] Inventor: Kenji Kurita, Tokyo, Japan

[73] Assignee: Kabushiki Kaisha Toshiba, Kawasaki, Japan

[21] Appl. No.: 772,970

[22] Filed: Oct. 8, 1991

[30] Foreign Application Priority Data

Oct. 9, 1990 [JP] Japan ..... 2-106019[U]

[51] Int. Cl.[5] ..... B41J 2/335

[52] U.S. Cl. ..... 346/76 PH

[58] Field of Search ..... 346/76 PH; 400/120

[56] References Cited

U.S. PATENT DOCUMENTS 4,342,040 7/1982 Fujita et al. ..... 346/76 PH

FOREIGN PATENT DOCUMENTS 0089375 5/1985 Japan ..... 346/76 PH 0032766 2/1986 Japan ..... 346/76 PH 0141571 6/1986 Japan ..... 346/76 PH

*Primary Examiner*—Benjamin R. Fuller

*Assistant Examiner*—Huan Tran

*Attorney, Agent, or Firm*—Finnegan, Henderson, Farabow, Garrett & Dunner

[57] ABSTRACT

A thermal head apparatus comprises a heat radiating member, a board having a heater and attached on the upper surface of the heat radiating member, a platen roller brought into contact with a heater formed on the board and rotated to transfer a recording paper sheet on the heater, a roller shaft supporting the platen roller, a pair of bearings supporting both end portions of the roller shaft, a first positioning member formed integral with an end portion of the heat radiating member and abutting on the bearings of the roller shaft, and a second positioning member formed integral with the other end portion of the heat radiating member and abutting on the bearings of the roller shaft.

16 Claims, 8 Drawing Sheets

THERMAL HEAD APPARATUS AND METHOD OF ASSEMBLING THERMAL HEAD APPARATUS

BACKGROUND OF THE INVENTION

1. Field of the Invention

This invention relates to a thermal head apparatus wherein a board, a heat radiating member and a platen roller constitute a unit, and a method of assembling a thermal head apparatus wherein the shaft of the platen roller is supported by bearings.

2. Description of the Related Art

Thermal head apparatuses are widely used in printers connected to computers. In a type of thermal head apparatus, a board, a heat radiating member, and a platen roller constitute a unit. The thermal head apparatus of this type has the following structure.

The heat radiating member is made of, for example, aluminum. The board made of, for example, ceramic is adhered to the upper surface of the heat radiating member. A heater is formed on the board. The platen roller is arranged parallel with the board and in contact with the heater. The platen roller is supported by a roller shaft which passes through the center portion thereof, and both end portions of the roller shaft protrude from the ends of the platen roller.

The end portions of the roller shaft are rotatably supported by bearings which are fixed to suitable members.

The roller shaft is rotated by a rotational-driving apparatus. A recording paper sheet is transferred between the platen roller and the heater by means of rotation of the platen roller. Electric power and a printing signal are supplied from a printed circuit board to the heater, thereby thermal-printing an image on the recording paper sheet. Heat generated by the heater is radiated through the heat radiating member.

In the above thermal head apparatus, to perform accurate thermal recording, it is necessary for the platen roller to be in contact with the heater provided in the board at the position precisely above the heater. In other words, if the platen roller is not positioned at a right position with respect to the heater, the heat energy generated by the heater cannot be applied satisfactorily to the recording paper sheet. As a result, color development on a recording portion of the paper sheet may be irregular or color is not developed at all, thus rendering a recorded image unclear. Hence, it is necessary to position the platen roller exactly above the heater.

In a conventional thermal head apparatus, positioning members are provided on both end portions of the heat radiating member to position the platen roller. The bearings for supporting the ends of the roller shaft are positioned by the positioning member pair. As a result, the platen roller is positioned with respect to the heater.

More specifically, each of the positioning members has a pair of raised portions on both sides of a point A where the platen roller is in contact with the heater, i.e., the sheet-entrance side and the sheet-exit side. The bearings are engaged with the raised portions and fixed to suitable members as described above. When the platen roller is rotated to transfer a recording paper sheet, the outer surfaces of the bearings are brought into contact with the raised portions of the positioning members provided on the sheet-entrance side with respect to the point A. This is because friction occurs between the platen roller and the recording paper and reacts against the rotational force of the platen roller transferring the recording paper sheet, thereby biasing the platen roller in the reverse direction. In this manner, the platen roller is positioned with respect to the point A with reference to a point B where the bearing is brought into contact with a positioning member.

In the structure as described above, it is necessary to accurately set a distance S between the point A where the platen roller touches the heater and the point B where the bearing touches the positioning member. To set the distance S, the following operation is performed.

First, an end of the heat radiating member is set against a jig. The board is positioned with reference to a plane C, an end of the heat radiating member, and attached thereto. Then, the positioning member is positioned with reference to the plane C and attached to the heat radiating member by a bolt. Each bearing is engaged with the corresponding end portion of the roller shaft, and inserted between the raised portions of the positioning member.

The above-described structure has the following drawbacks.

Setting of the distance S between point A and point B, includes three steps, i.e., attaching the board to the heat radiating member, attaching the positioning member to the heat radiating member, and engaging the bearings of the platen roller with the positioning members.

Attaching the board to the heat radiating member and attaching the positioning member to the heat radiating member are inevitably accompanied by assembling errors in the positions of the board and the positioning member. The distance S between the points A and B is affected by these errors in a multiplicational manner.

In summary, an error in each position greatly influences the distance S. Therefore, it is very time-consuming to set a distance S within a predetermined accuracy without an influence of errors in the positions of the board and the positioning member. Moreover, a complicated assembling jig is used to set a distance S, taken the influence of the errors into account.

SUMMARY OF THE INVENTION

It is accordingly an object of the present invention to provide a thermal head apparatus wherein a platen roller is positioned accurately and easily with respect to a heater.

It is another object of the present invention to provide a thermal head apparatus wherein the heat radiating effect of the heat radiating member is improved by using positioning members.

It is still another object of the present invention to provide a thermal head apparatus wherein vibration of the positioning member is prevented, thereby improving the reliability of the apparatus.

It is a further object of the present invention to provide a method of assembling a thermal head apparatus, by which the platen roller is positioned accurately and easily with respect to the heater.

According to the present invention, there is provided a thermal head apparatus comprising:

a heat radiating member having a pair of end portions which are opposed to each other and an upper surface located therebetween;

a board attached to the upper surface of the heat radiating member and having a heater formed in a direction along a line connecting the pair of end portions;

a platen roller having a pair of end portions, which is brought into contact with the heater on said board and is arranged in the direction in which the heater is provided said platen roller being rotated to transfer a recording paper sheet on the heater;

a roller shaft supporting the platen roller and having a pair of end portions which respectively protrude from the ends of the platen roller;

a pair of bearings, each having an inner and outer surface, for rotatably supporting the end portions of the platen roller;

a first positioning member, which is formed integral with one of the pair of end portions of the heat radiating member and is brought into contact with the outer surface of one of the bearings, for positioning the platen roller with respect to the heater; and a second positioning member, which is formed integral with the other end portion of the heat radiating member and is brought into contact with the outer surface of the other bearing, for positioning the platen roller with respect to the heater.

According to a specific form of the present invention, there is provided a thermal head apparatus wherein the first and second positioning members are respectively located on a paper-entrance side and a paper-exit side with a contact point of said platen roller with the heater interposed therebetween, and each of said first and second positioning members has a pair of elements having surfaces with which the outer surfaces of said bearings are brought into contact.

According to another form of the present invention, there is provided a thermal head apparatus wherein the elements of said first and second positioning members have inclined surfaces for guiding said bearings.

According to still another form of the present invention, there is provided a thermal head a wherein the first and second positioning members have a pair of elements on the paper sheet entrance side and the paper sheet exit side having surfaces abutting on the outer surface of one of said bearings, and one of the first and second positioning members has an element on the paper sheet entrance side having a surface abutting on the outer surface of the other bearing.

According to a further form of the present invention, there is provided a thermal head apparatus wherein the elements of said first and second positioning members have inclined surfaces for guiding said bearings.

A method of assembling a thermal head apparatus according to the present invention comprises the steps of:

preparing a board having a heater, and a heat radiating member having end portions, first and second positioning members being respectively formed integral with said end portions;

placing a platen roller on the upper surface of the board;

engaging both end portions of the roller shaft supporting the platen roller with bearings; and bringing the bearings engaged with the roller shaft into contact with the first and second positioning members, thereby positioning the platen roller with respect to the heater.

According to the above apparatus, an operation of setting the distance S between a position A where the platen roller touches the heater and a position B where the bearing touches the positioning member includes two steps, i.e., positioning and attaching the board to the heat radiating member, and bringing the bearings of the roller shaft into contact with the positioning member formed on the heat radiating member. The step of attaching the positioning member to the heat radiating member is omitted. Thus, the number of steps required for setting the distance S is fewer than that of the conventional technique. Accordingly, the influence of the errors in the positions of elements is reduced as compared to the conventional technique.

Hence, the distance S between the point A where the platen roller touches the heater and the point B where the bearing touches the positioning member can be set easily and accurately with a minimum influence of errors of the positions of these elements.

As described above, the positioning members are formed integral with the heat radiating member to omit the step of attaching the positioning members to the heat radiating member. Therefore, the influence of the errors in the positions of element is decreased.

Moreover, since the positioning members are formed integral with the heat radiating member, heat is discharged from the heat radiating member through the positioning members to the outside. Thus, the heat radiating effect is improved as compared to the conventional apparatus and the board is prevented from being heated by the heater.

In addition, by virtue of this structure, since the positioning member is prevented from vibrating due to rotation of the platen roller, no noise occurs and the platen roller does not vibrate. In the conventional apparatus, since the bolts which connect the positioning members to the heat radiating plate are loosened due to the rotation of the platen roller, the positioning member and the platen roller vibrate, resulting in noise and a unsatisfactory record.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a front view showing a thermal head apparatus according to a first embodiment of the present invention, taken along the line I—I in FIG. 2;

DETAILED DESCRIPTION OF THE PREFERRED EMBODIMENTS

A first embodiment of the present invention will now be described with reference to FIGS. 1 to 5.

Figure 4:
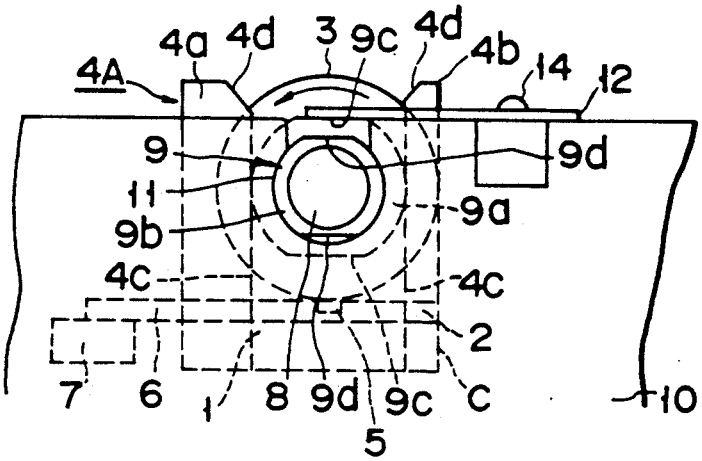
FIG. 4 is a side view showing the thermal head apparatus shown in FIG. 1.
Figure 5:
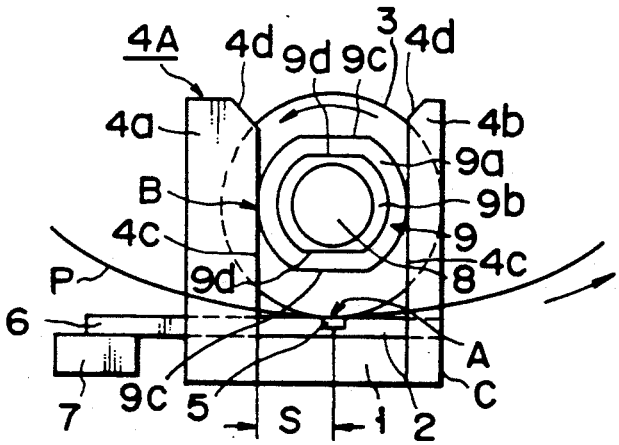
FIG. 5 is a side view showing a state of the thermal head apparatus in which a bearing fixing member is removed.
Figure 2:
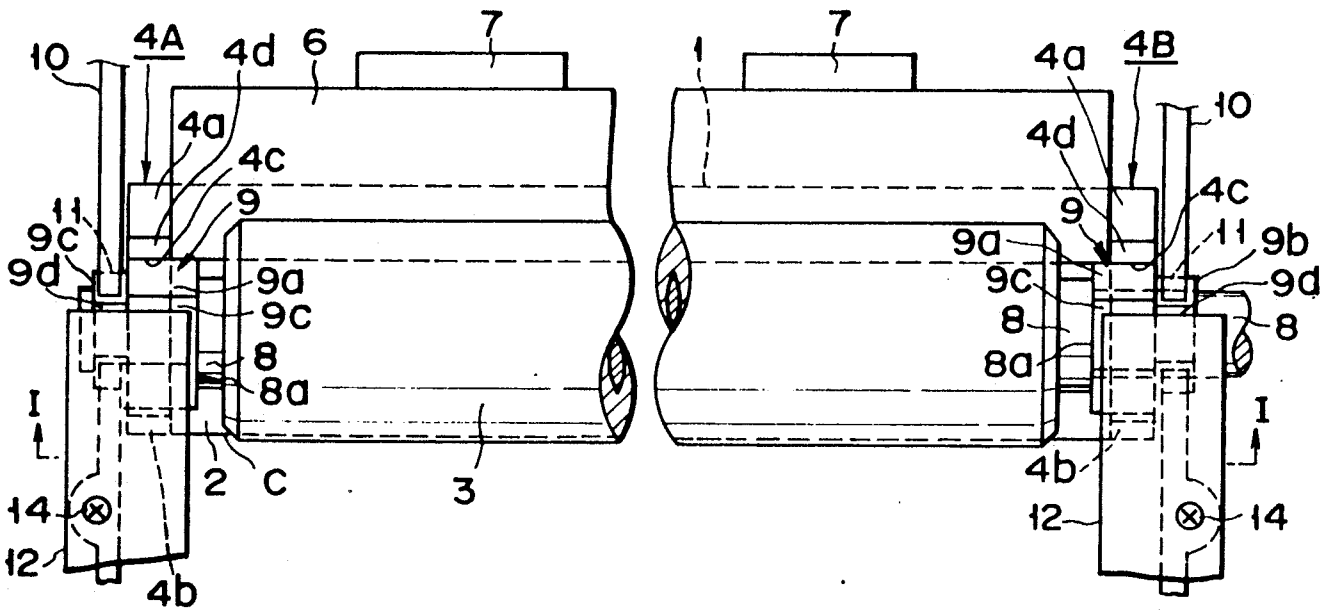
FIG. 2 is a plan view showing the thermal head apparatus shown in FIG. 1.
Figure 3:
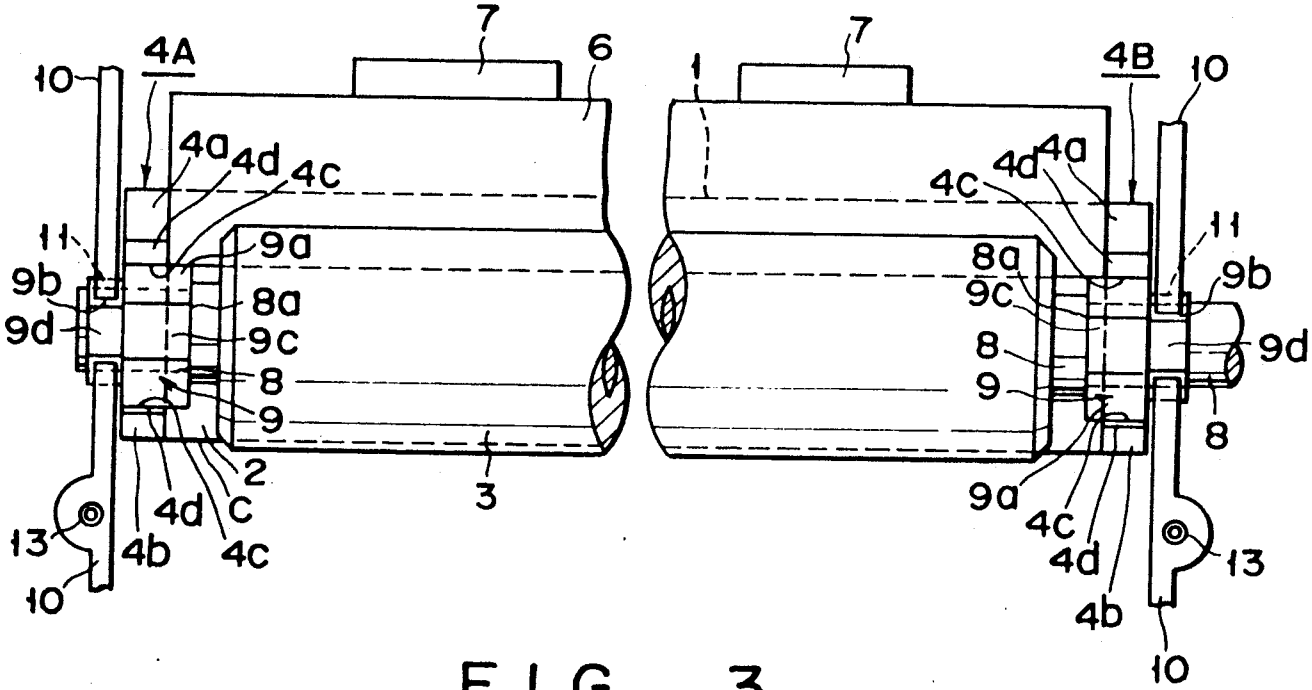
FIG. 3 is a plan view showing the thermal head apparatus shown in FIG. 1, wherein an element 12 is omitted.
Figure 4:
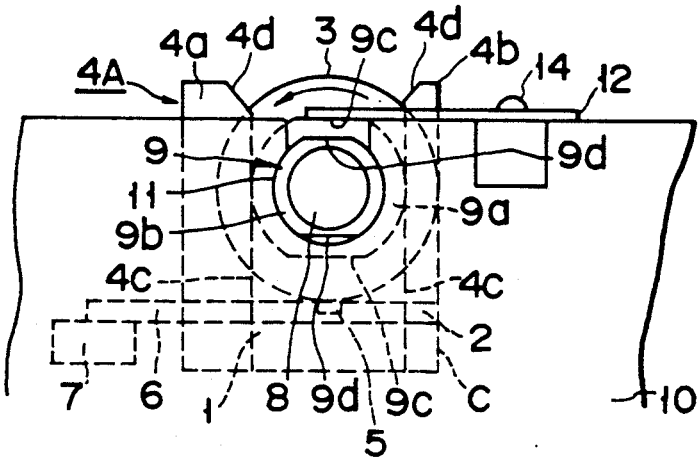
Figure 5:
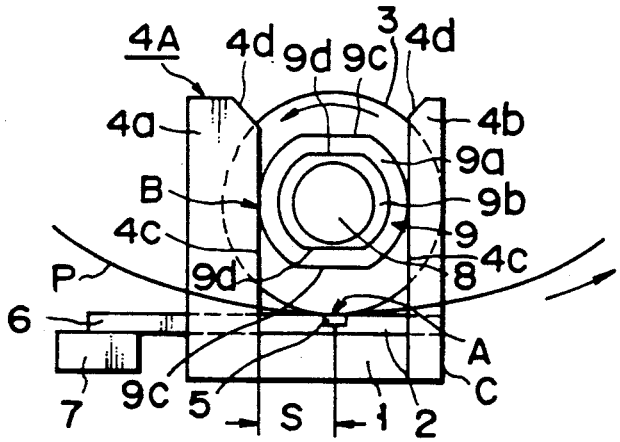

FIG. 1 is a cross-sectional view, FIGS. 2 and 3 are plan views, and FIGS. 4 and 5 are side views showing the thermal head apparatus. In FIG. 3, an element 12 is omitted for easier reference. In the figures, reference numerals 1, 2 and 3 respectively denote a heat radiating member, a board, and a platen roller.

The heat radiating member 1 is an elongated plate, having an upper surface between two opposing end portions. First and second positioning members 4A and 4B are formed integral with the end portions of the heat radiating member 1. Each of the first and second positioning members 4A and 4B are constituted by a pair of positioning pieces 4*a* and 4*b*. The positioning pieces 4*a* and 4*b* are separated from each other with a space therebetween in the width direction of the heat radiating plate 1, and extend vertically from the end portions of the heat radiating member 1. The distance between the inner side surfaces 4*c* (the side surfaces which face to each other) of the positioning pieces 4*a* and 4*b* is slightly longer than the diameter of a larger diameter portion of a bearing 9 for supporting a roller shaft 8 of the platen roller 3. The outer surface of the bearing 9 is brought into contact with the vertically-extending inner side surfaces 4*c* of the pair of the positioning members. The positioning pieces 4*a* and 4*b* have inclined surfaces 4*d* which face to each other. The inclined surfaces 4*d* slant to the space between the positioning pieces 4*a* and 4*b*. The pair of positioning pieces 4*a* and 4*b* correspond to a pair of supporting metallic parts of a conventional thermal head apparatus. According to the present invention, the positioning pieces 4*a* and 4*b* are formed of aluminum die-cast integrally with the heat radiating member 1.

The board 2 is an elongated material made of ceramics or the like, and has the same length and a smaller width as compared to the heat radiating member 1. A heater 5 is provided on the central portion of the upper surface of the board in its longitudinal direction, i.e., along the line connecting both ends of the heat radiating member. Wires (not shown) are formed on the board 2 to connect the heater 5 thereto. The board 2 is adhered to the upper surface of the heat radiating member 1. The positioning pieces 4*a* of the first and second positioning members 4A and 4B are arranged separately from the positioning pieces 4*b* thereof with a point A, where the platen roller 3 touches the heater, interposed therebetween, i.e., on the sheet-entrance side where recording paper sheet P is inserted and on the sheet-exit side where it is discharge.

A printed circuit board 6 is adhered to the heat radiating member 1, in proximity to the board 2. Conductor (not shown) is formed on the upper surface of the printed circuit board 6 to connect the wires on the board 2 to a connector 7, which is formed on the end portion of the printed circuit board 6.

A roller shaft 8 is inserted through the platen roller 3 and fixed thereto along the central axis thereof. The end portions of the roller shaft 8 protrude from the ends of the platen roller 3.

The platen roller 3 is arranged along the heater 5 and precisely above the heater 5 on the board 2, such that a portion of the platen roller is brought into contact with the upper surface of the heater 5.

The end portions of the roller shaft 8 which protrude from the ends of the platen roller 3 are inserted into and rotatably supported by the bearings 9.

A structure of the bearings 9 and means for supporting them to the positioning members will now be described.

The bearings 9 are cylindrical members formed of an abrasive resistant synthetic resin and each have an inner circular surface and an outer circular surface. Each of the bearings has a larger diameter portion 9*a* and a smaller diameter portion 9*b*, which is located on the opposite side of the platen roller 3 from the larger diameter portion 9*a*. The outer surface of the larger diameter portion 9*a* includes two cut portions 9*c* which are parallel to each other with respect to the center of the larger diameter portion 9*a*, and the outer surface of the smaller diameter portion 9*b* includes two cut portions 9*d* which are parallel to each other with respect to the center of the smaller diameter portion 9*b*.

To fix the bearings 9 to the heat radiating member 1, bearing fixing members are prepared. In this embodiment, a pair of plate members 10 is used. The plate members 10 are formed perpendicular to the axis of the platen roller 3 on both end portions of the thermal head apparatus. Circular bearing fixing portions 11 are formed in the upper portions of the plate members 10. The upper portion of the bearing fixing member 11 is opened on the upper edges of the plate member 10. The bearing fixing portion 11 has the same diameter as that of the smaller diameter portion 9*b* of the bearing 9, and the opening area has the same length as the interval between the cut portions 9*d* of the smaller diameter portion 9*b*.

The smaller diameter portions 9*b* of the bearings 9 are first engaged with the openings in the bearing fixing portions 11 of the plate members 10, such that the cut portions 9*d* are perpendicular to the heat radiating plate 1. Thereafter, the bearings 9 are rotated by 90°, so that the cut portions 9*d* are parallel to the heat radiating member 1. As a result, the smaller diameter portions 9*b* are fixed to the bearing fixing portions 11. The larger diameter portions 9*a* are engaged with the upper portions of the positioning pieces 4*a* and 4*b* of the first and second positioning members 4A and 4B. The cut portions 9*c* of the larger diameter portions 9*a* are parallel to the heat radiating member 1. Keep plates 12 are fixed to the upper ends of the plate members 10 with holes formed therein and screw holes 13 formed in the plate member 10 by means of screws 14. The cut portions 9*c* of the larger diameter portions 9*a* of the bearings 9 are pressed by the keep plates 12 from the upper side, and prevented from rotating.

Stepped portions 8*a* are formed on the end portions of the roller shaft 8. The stepped portions 8*a* are brought into contact with the larger diameter portions 9*a* of the bearings 9 to prevent the roller shaft 8 from moving in its axial direction.

In the thermal head apparatus, the roller shaft 8 is rotated by a rotational driving apparatus (not shown) in a direction indicated by the arrows shown in FIGS. 4 and 5, with support by the pair of bearings 9. The platen roller 3 is rotated in the same direction along with the roller shaft 9. A recording paper sheet P is inserted between the platen roller 3 and heater 5 on the board 1 and transferred by rotation of the platen roller 3. The recording paper sheet P is pressed against the heater 5 by the platen roller 3 at the point A shown in FIG. 5. Electric power and a printing signal is supplied to the heater 5 from the wiring board 6. Thus, an image is thermal-printed on the recording paper sheet P by the heater 5.

The thermal head apparatus is assembled in the following manner.

The platen roller 3 is positioned so that the central axis thereof is located precisely above the heater 5 on the basis of the following idea.

The outer surface of each bearing 9 is brought into contact with the side surface 4c of the positioning piece 4a of the first and second positioning members 4A and 4B at a point B by friction between the recording paper sheet P and the board 2. A distance S between the point A where the platen roller 3 touches the heater 5 and the point B where the bearing 9 touches the positioning piece 4a is set.

The distance S is set in the following manner. The board 2 is positioned with reference to a plane C of the heat radiating member 1 and adhered on the upper surface of the heat radiating member 1. The plane C is an end of the heat radiating member 1 which is located on the paper-exit side of the point A along the axial direction of the platen roller 3. The bearings 9 are engaged with both ends of the roller shaft 8, and inserted between the positioning pieces 4a and 4b of the first and second positioning members 4A and 4B. Thus, the distance S is set.

As described above, the distance S between the points A and B is set through the two steps: positioning the board 2 and attaching it to the heat radiating member 1; and placing the platen roller 3 on the heat radiating member 1 by supporting the bearings 9 of the platen roller 3 with the positioning pieces 4a and 4b formed integral with the heat radiating plate 1.

Therefore, the influence of the errors in the positions of elements is reduced as compared to the conventional technique. Hence, the distance S can be set easily and accurately with a minimum influence of the errors of the positions of these elements, using a simple jig.

Since the positioning pieces 4a and 4b are formed integral with the heat radiating member 1, heat is transmitted from the heat radiating member 1 directly to the positioning pieces 4a and 4b , and satisfactorily discharged therethrough. Moreover, noise and defective recording due to vibration of the platen roller are prevented, unlike in the conventional apparatus in which the positioning pieces 4a and 4b are loosened because of rotation of the platen roller 3.

Since the inclined surfaces 4d are formed in the upper portions of the positioning pieces 4a and 4b, the bearings can easily be inserted between the positioning pieces 4a and 4b.

The structure of the first and second positioning members 4A and 4B is not limited to the above embodiment.

A second embodiment of the present invention will now be described with reference to FIGS. 6 to 8, wherein like components are identified with like reference numerals as used in FIGS. 1 to 4.

In the second embodiment, each of the first and second positioning members 4A and 4B has only one positioning piece 4a. The positioning piece 4a includes an inclined surface 4d and a side surface 4c with which the outer surface of the larger diameter portion 9a of the bearing 9 is brought into contact.

Figure 7:
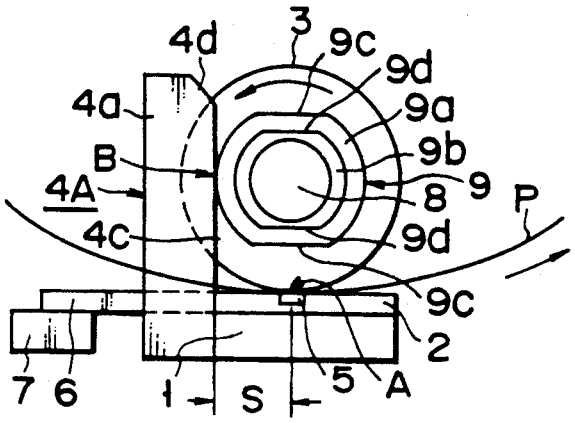
FIG. 7 is a side view showing the thermal head apparatus shown in FIG. 6.

During in a recording operation, when the platen roller 3 is rotated in the direction indicated by the arrow shown in FIG. 7, the outer surface of the bearing 9 of the roller shaft 8 are brought into contact with the surface 4c of the positioning pieces 4a at a point B.

In the same manner as in the first embodiment, a distance S between a point A where the platen roller 3 touches the heater 5 and the point B where the bearing 9 touches the positioning member 4a can be set easily with satisfactory accuracy.

Figure 6:
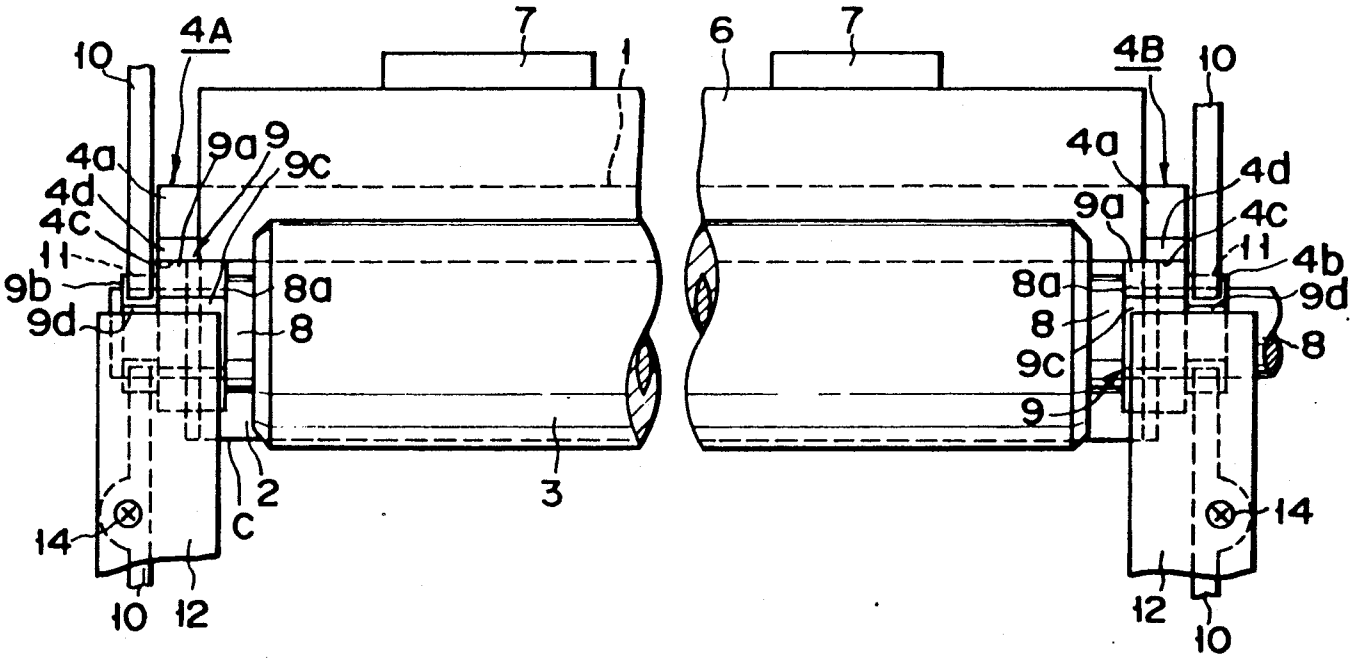
FIG. 6 is a plan view showing a thermal head apparatus according to a second embodiment of the present invention.
Figure 8:
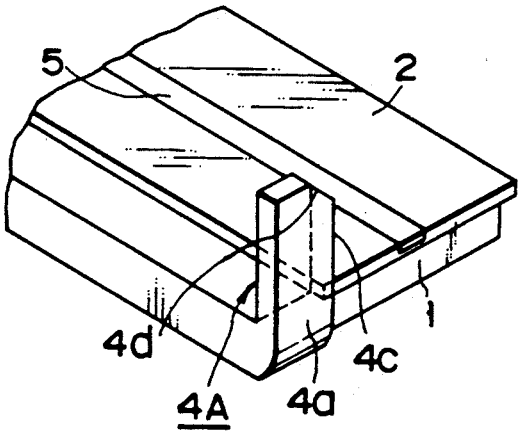
FIG. 8 is a perspective view showing a positioning member.

As is shown in FIGS. 6 and 8, according to the second embodiment, the board 2 is longer than the heat radiating member 1, with both ends thereof protruding from the heat radiating member 1, so that the board 2 is positioned with reference to the side surfaces 4c of the positioning pieces 4a. More specifically, an end of the board 2 are brought into contact with the side surfaces 4c of the positioning pieces 4a, thereby achieving the positioning of the board 2.

Figure 9:
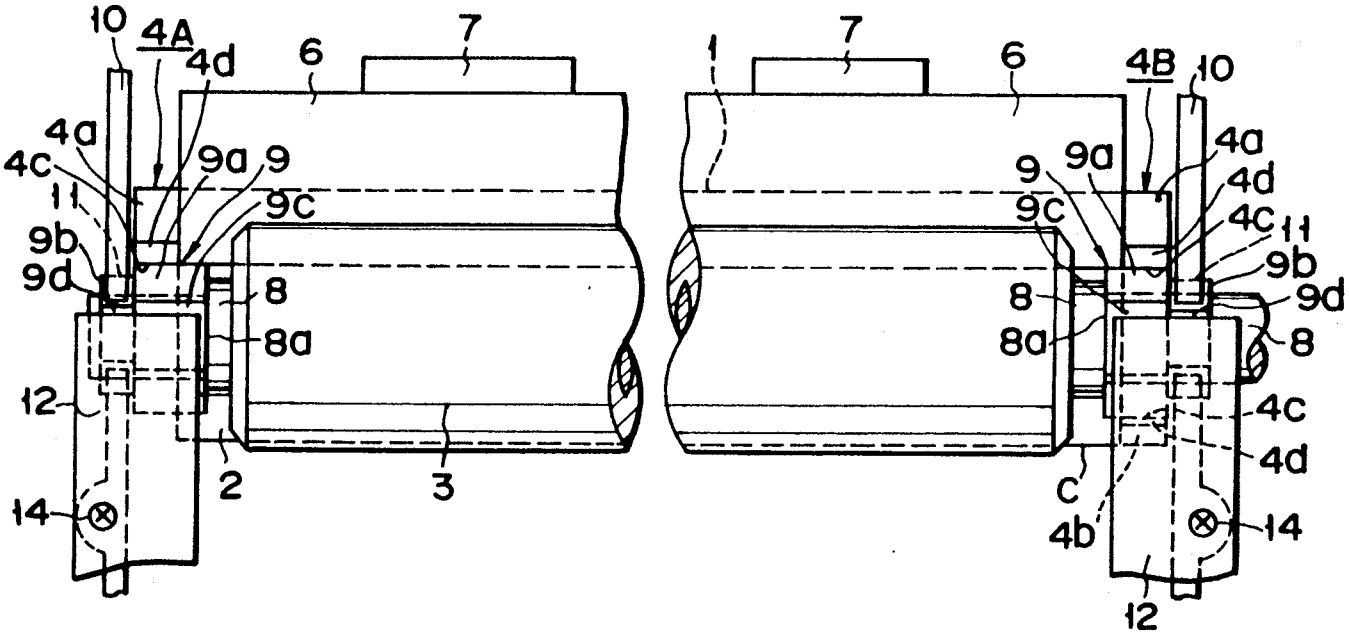
FIG. 9 is a plan view showing a thermal head apparatus according to a third embodiment of the present invention.
Figure 10:
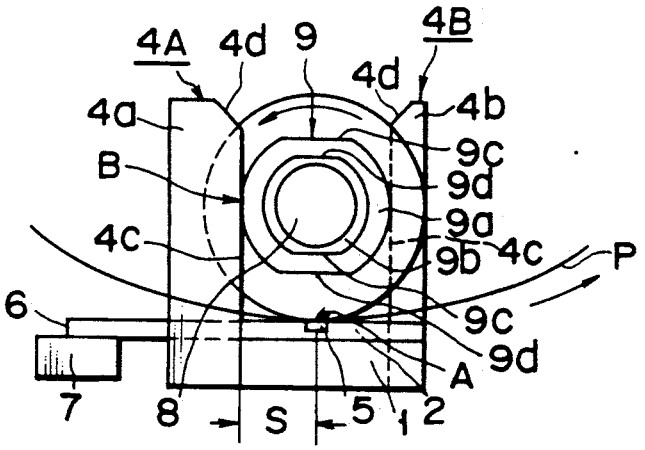
FIG. 10 is a side view showing the thermal head apparatus shown in FIG. 9.

A third embodiment of the present invention will be described with reference to FIGS. 9 and 10.

In the third embodiment, the first positioning member 4A has a positioning piece 4a on one end portion of the heat radiating member 1, and the second positioning member 4B has positioning pieces 4a and 4b on the other end portion of the heat radiating member 1. Alternatively, the first positioning member 4A may have a positioning pieces 4a and 4b on one end portion of the heat radiating member 1 and the second positioning member 4B may have a positioning piece 4a on the other portion of the heat radiating member 1. Each of the positioning pieces 4a and 4b has an inclined surface 4d and a side surface 4c which abuts the outer surface of the larger diameter portion 9a. The third embodiment also brings about the same effect as in the first and second embodiments.

In the above embodiments, the head radiating member is of a plate shape but this may be of another shape such as to radiate the heat.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A thermal head apparatus comprising:

a heat radiating member having a pair of end portions which are opposed to each other and an upper surface located therebetween;

a board attached to the upper surface of said heat radiating member and having a heater formed in a direction along a line connecting the pair of end portions;

a platen roller, having a pair of end portions, which is brought into contact with the heater on said board and is arranged in the direction in which the heater is provided, said platen roller being rotatable to transfer a recording paper sheet onto the heater;

a roller shaft supporting said platen roller and having a pair of end portions which respectively protrude from the pair of end portions of said platen roller;

a pair of bearings, each having an inner and outer surface, for rotatably supporting the pair of end portions of said platen roller, said pair of bearings having a cut portion in a portion of the outer surface with a face extending in a plane parallel to a diameter of the bearing;

a first positioning member, which is formed integral with one of the pair of end portions of said heat radiating member being brought into contact with the outer surface of one of said pair of bearings, for positioning said platen roller with respect to said heater;

a second positioning member, which is formed integral with the other end portion of said heat radiating member being brought into contact with the outer surface of the other of said pair of bearings, for positioning said platen roller with respect to said heater; and a pair of bearing fixing members, formed on outer sides of said first and second positioning members, having bearing fixing portions including open portions, provided on upper edges of the bearing fixing members, for inserting or withdrawing said bearings into or from said bearing fixing portions, wherein the open portions allow passage of said bearings when the plane of the face of the cut portion is perpendicular to said heat radiating member, and fix said bearings to the bearing fixing members when the plane of the face of the cut portion is parallel with said heat radiating member.

2. A thermal head apparatus according to claim 1, wherein said first and second positioning members are respectively located on a paper-entrance side and a paper-exit side with a contact point of said platen roller with the heater interposed therebetween, and each of said first and second positioning members has a pair of elements having surfaces with which the outer surfaces of said bearings are brought into contact.

3. A thermal head apparatus according to claim 2, wherein said elements of said first and second positioning members have inclined surfaces for guiding said bearings.

4. A thermal head apparatus according to claim 1, wherein said first and second positioning members are located on a paper-entrance side and have elements having surfaces with which the outer surfaces of said bearings are brought into contact.

5. A thermal head apparatus according to claim 4, wherein said elements of said first and second positioning members have inclined surfaces for guiding said bearings.

6. A thermal head apparatus according to claim 1, wherein one of the first and second positioning members has a pair of elements on a paper sheet entrance side and a paper sheet exit side having surfaces abutting on the outer surface of one of said bearings, and the other one of the first and second positioning members has an element on the paper sheet entrance side having a surface abutting on the outer surface of the other bearing.

7. A thermal head apparatus according to claim 6, wherein the elements of said first and second positioning members have inclined surfaces for guiding said bearings.

8. A thermal head apparatus according to claim 1, wherein the bearings have large diameter portions with a diameter larger than portions of the bearings which are engaged with said bearing fixing portions at a location where said bearing fixing members are brought into contact with said first and second positioning members.

9. A thermal head apparatus according to claim 8, wherein the cut portion is disposed on the large diameter portion, and comprising a keep member disposed to be brought into contact with the respective face of the cut portions so that said bearings are prevented from rotating.

10. A thermal head apparatus according to claim 9, wherein the first and second positioning members are respectively located on a paper entrance side and a paper exit side with the point of contact of the platen roller and the heater interposed between said first and second positioning members, and each of said first and second positioning members has a pair of elements including surfaces for contacting with the outer surfaces of said bearings.

11. A thermal head apparatus according to claim 10, wherein the elements of the first and second positioning members each include an inclined surface for guiding said bearings.

12. A thermal head apparatus according to claim 9, wherein said first and second positioning members are located on a paper entrance side and have elements including surfaces for contacting with the outer surfaces of said bearings.

13. A thermal head apparatus according to claim 12, wherein the elements of the first and second positioning members include an inclined surface for guiding said bearings.

14. A thermal head apparatus according to claim 9, wherein one of the first and second positioning members has a pair of elements on the paper sheet entrance side and the paper sheet exit having surfaces abutting on the outer surface or one of said bearings, and the other one of the first and second positioning members has an element on the paper sheet entrance side having a surface abutting on the outer surface of the other bearings.

15. A thermal head apparatus according to claim 14, wherein the elements of said first and second positioning members include an inclined surface for guiding said bearings.

16. A method of assembling a thermal head apparatus having a board, a heater, a heat radiating member having end portions, a platen roller with bearings having a cut portion formed in parallel with a diameter of the bearing in an outer surface portion thereof, first and second positioning members said positioning members bearing fixing portions being respectively formed integral with said end portions, comprising the steps of:

placing a platen roller on the upper surface of the board;

engaging both end portions of the roller shaft supporting the platen roller with bearings;

bringing the bearings engaged with the roller shaft into contact with the first and second positioning members;

positioning the surface of the cut portion perpendicular to said heat radiating member for placing the bearings into and removing the bearings from said bearing fixing portions positioning the surface of the cut portions parallel to said head radiating member to fix said bearings to the bearing fixing member thereby positioning the platen roller with respect to the heater.

* * * * *